United States Patent [19]

King

[11] Patent Number: 4,750,657

[45] Date of Patent: Jun. 14, 1988

[54] BODY-SUPPORTED CLIP-BOARD

[76] Inventor: William L. King, Rte. One, Box 382 A, Moultrie, Ga. 31768

[21] Appl. No.: 634,285

[22] Filed: Jul. 25, 1984

[51] Int. Cl.[4] ..... A45F 5/00

[52] U.S. Cl. ..... 224/270; 248/444

[58] Field of Search ..... 224/270; 108/43; 297/4; 248/444

[56] References Cited

U.S. PATENT DOCUMENTS

| | | | |
|---|---|---|---|
| 126,213 | 4/1872 | Ireland et al. | 224/270 |
| 544,684 | 8/1895 | Parker | 224/270 |
| 1,593,166 | 7/1926 | Flach | 224/270 |
| 2,861,854 | 11/1958 | Best | 224/270 |

*Primary Examiner*—Henry J. Recla
*Assistant Examiner*—David Voorhees

[57] ABSTRACT

A body supported clipboard having a side arm extending from the main writing surface, defining with the writing surface a curved inner edge for the midsection of a person. A plurality of posts extend from the writing surface, one post located on the sidearm and second post fixed to the writing surface diagonally to the side arm. A strap fixed to the posts and encircling the wearer to hold the writing board on the wearer. The second post extends above the writing surface to prevent interference of the strap with the wearer's hand.

4 Claims, 1 Drawing Sheet

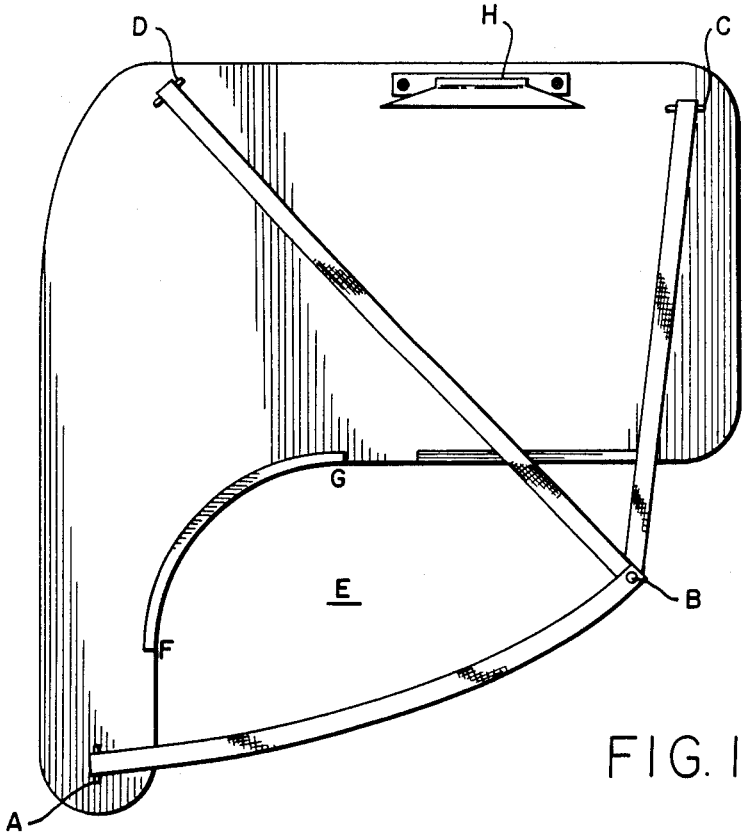
FIG. 1
FIG. 2
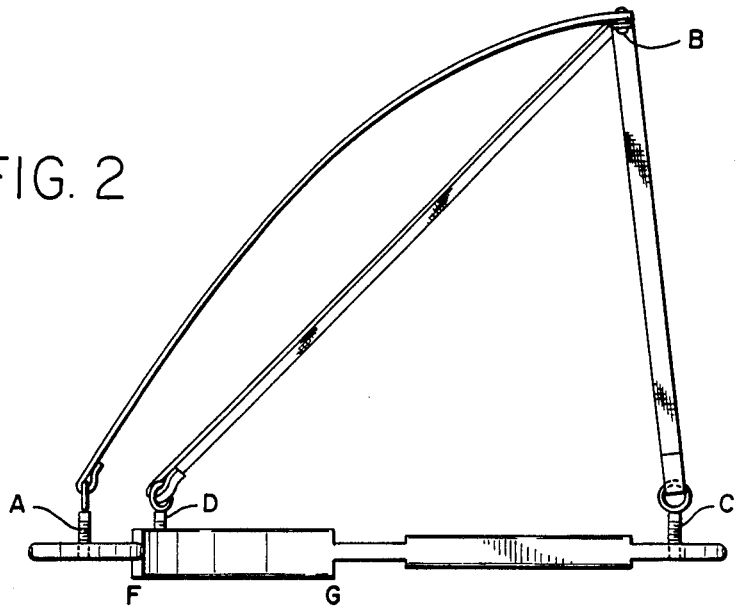

BODY-SUPPORTED CLIP-BOARD

BACKGROUND OF THE INVENTION

Even though the "clip-board" is the most widely used portable writing surface it has limitations in use. Both hands have to be occupied in its use, one to hold the "clip-board" and one to write. Only one hand, the writing one, can ever be freed for use (by placing the writing instrument under the clip's slot where it is subject to even fall off). More ideal use could be made of a portable writing surface if both hands could be free at once such as when picking up or examining an item. Furthermore, the steadiness of the "clip-board" is subject to question since the surfaces wobbles a little in the hands. The best penmanship that a person has is not able to show because the surface is not solidly firm and stationary.

Many tasks in industry and other endeavors could be more easily accomplished with a body-supported lightweight walk-about writing surface. An instance of need is inventories of parts which requires much hand movement and walking with writing done at intervals in a back and forth pattern.

In making somewhat of a patent search in 248/444 I felt that similar items patented in the past had drawbacks. I did not find that any body-supported writing surface incorporated the standard clip of the "clipboard". One device did go to great lengths to explain how what looked like adjustable rollers to the side would hold a book in its opened position. The "clip" would allow the pages to be turned quicker and hold the book without its having a tendency to close. Also the "clip" shows in favorable light when compared to adjustable straps moved on and off the book to hold it in its opened position. I believe that it was the device that had the afore-mentioned rollers that had what appeared to be a very cumbersome vertical-post apparatus to facilitate rotation of the surface to accomodate right or left-handed use. I suggest that a surface that can simply be flipped over to accomodate use of either hand would eliminate the weight of the post. One writer was supported with a brace to the leg which does not maximize its mobility or stability. One had its weight supported by a strap around the neck and this is bound to be tiring to the neck in any prolonged use. I am not aware that any of these devices have been marketed to an appreciable degree.

The body-mounted writer I offer for consideration is supported by the normal, comfortable posture of the user and it allows maximum ease of movement. It is a portable podium. Nothing prevents its user from sitting and using the surface as a desk in front of him.

BRIEF DESCRIPTION OF THE DRAWINGS

In the drawings:

FIG. 1 is a top view of the body-supported clipboard.

FIG. 2 is a side view of the body-supported clipboard.

DETAILED DESCRIPTION OF THE INVENTION

"E" is the right-handed user. "B" is the top of the user's right shoulder. "C" and "D" are vertical posts perpendicular to the plane of the writing surface and high enough to allow easy hand clearance under the mounting straps which are represented by the dash lines. "A" is attachment for strap at the user's waistline in the back. It does not need to be positioned so far behind the user to interfere at the back of the user while sitting "H" is positioning for the standard "clipboard" clip. "F" and "G" are curved because they contact the user's mid-section and are of average tummy contour. "F" and "G" represent also a plane perpendicular to the writing surface. "F" and "G" are then allowing more surface area to contract the tummy then there would be if only the thickness of the board in general touched here.

The forward portion of the writing board is elevated somewhat in relation to the edge closest to the user. This allows comfort of the writing angle. Widths and thicknesses of materials at point "G" are tapered and reduced so that sharp edges don't cause discomfort to the user. "A" and "C" and "D" can be removed from the board along with the straps for transfer to the other side for left-handed use. This is because they are screw-type pegs with threads that secure from either top side, whichever is used (dual holes close together in the writing board). A bolt and nut combination could be used with only one hole in the board and its case of removal allowing the board to be flipped over. "A" and "C" and "D" pegs or bolts are made with an "eye" at their top. They are screwed indepently onto the board and then afterwards the straps are fastened through the "eye". This prevents any twisting of the straps. Peg posts or bolt posts "A" and "C" and "D" will each go into their respective holes and the eye in its finished position will angle to best fit the angle that the straps approach them. Point "B" is made to be comfortable by extra wide straps here for best bearing surface on the shoulder and the very softest (yet strong) materials used. It is possible that the strap represented by dash line "D" "B" could be eliminated if testing at the design stages indicate that one strap "A" "B" "C" is sufficient to hold the board up with no side to side tilt. The outline and the size of the writing surface is such that it will meet the specific needs of users. All corners are contoured in an appropriate fashion.

I claim:

1. A body supported clipboard for use selectively by righthanded and lefthanded people, said clipboard being arranged for support generally in the front of a person with said clipboard contacting said person generally in the mid-section, said clipboard comprising a writing board having first and second opposed surfaces, a side arm extending inwardly from said writing board and defining with said writing board a curved inner edge for engaging said mid-section of said person with said side arm extending to one side of said person, a plurality of posts extending upwardly from said writing board, a first post of said plurality of posts being fixed to the extending end of said side arm, and a second post of said plurality of posts being fixed to said writing board diagonally opposite from said first post, and strap means fixed to the upper end of each post of said plurality of posts for supporting said writing board, said second post having sufficient length that said strap means is above the hand of said person when on the surface of said writing board for preventing interference of said strap means with said hand, and releasable securing means for selectively fixing said plurality of posts to said first surface and said second surface of said writing board so that said writing board can be flipped over for use by righthanded and lefthanded people.

2. A body supported clipboard as claimed in claim 1, and further including a clip removably fixed to said writing board, said clip being selectively fixable to said first side and said second side of said writing board.

3. A body supported clipboard as claimed in claim 1, and further including a lip extending perpendicularly to said writing board, said lip being generally coextensive with said curved inner edge.

4. A body supported clipboard as claimed in claim 3, said writing board being generally rectangular with said side arm extending beyond such rectangle, and including a third post of said plurality of posts, said second post being adjacent to the outer edge of said writing board, said third post being adjacent to said outer edge and in the opposite corner from said second post, said strap means comprising a first strap portion extending from said first post to said person's shoulder, a second strap portion extending from said second post to said person's shoulder, and a third strap portion extending from said third post to said person's shoulder, said first, second and third strap portions being connected at said shoulder.

* * * * *